US006012421A

United States Patent [19]

Kusche et al.

[11] Patent Number: 6,012,421

[45] Date of Patent: Jan. 11, 2000

[54] INTERNAL COMBUSTION ENGINE WITH IMPROVED LUBRICATION SYSTEM

[75] Inventors: David W. Kusche; Neil M. Andrasko, both of Oshkosh; James P. Wagner, Hartford, all of Wis.

[73] Assignee: Brunswick Corporation, Lake Forest, Ill.

[21] Appl. No.: 09/092,163

[22] Filed: Jun. 5, 1998

[51] Int. Cl.[7] ..... F01M 1/04

[52] U.S. Cl. ..... 123/196 R; 123/196 R; 123/196 W; 184/6.18

[58] Field of Search ..... 123/196 R, 196 W, 123/196 CP, DIG. 5; 184/6.5, 6.18, 6.7

[56] References Cited

U.S. PATENT DOCUMENTS

| | | | |
|---|---|---|---|
| 2,937,715 | 5/1960 | Jackson et al. | 184/6.5 |
| 4,121,551 | 10/1978 | Turner | 123/59 B |
| 4,372,258 | 2/1983 | Iwai | 123/73 AD |
| 4,599,979 | 7/1986 | Breckenfeld | 123/73 AD |
| 4,820,212 | 4/1989 | McElroy | 440/88 |
| 5,052,355 | 10/1991 | Ito et al. | 123/196 R |
| 5,517,959 | 5/1996 | Kato et al. | 123/196 AB |
| 5,524,581 | 6/1996 | Rush, II | 123/90.34 |
| 5,632,241 | 5/1997 | Binversie | 123/196 W |

*Primary Examiner*—Noah P. Kamen
*Assistant Examiner*—Hai Huynh
*Attorney, Agent, or Firm*—William D. Lanyi

[57] ABSTRACT

A lubricating system for an internal combustion engine is provided wherein oil flows from a compressor oil drain port to a region of the engine which is to be lubricated. The source of lubricating fluid, such as the compressor, is transmitted through a first conduit between the compressor and a lubricant supply region of the engine block. The lubricant supply region is located between a first seal region, or labyrinth seal, and a region to be lubricated which can be a center main bearing. The region to be lubricated is located between the lubricant supply region and a first lower pressure region of the engine, such as the crankcase region associated with one of the cylinders of the engine. A check valve is used to resist flow of the lubricating fluid in a direction from the lubricant supply region to the lubricating fluid source.

17 Claims, 5 Drawing Sheets

INTERNAL COMBUSTION ENGINE WITH IMPROVED LUBRICATION SYSTEM

BACKGROUND OF THE INVENTION

1. Field of the Invention

The present invention relates generally to an improved lubrication system for an internal combustion engine and, more particularly, for a lubrication system that advantageously utilizes the pulsating pressure variations within certain sections of the crankcase to draw lubricating fluid through main bearing regions that would otherwise be difficult to lubricate.

2. Description of the Prior Art

Many portions of an internal combustion engine require lubrication to avoid damage caused by friction at various interfaces between stationary and moving components. For example, oil in provided in the interface region between the cylinder walls of the engine and the outer surfaces of the pistons. Furthermore, various regions of the crankshaft require support by bearings which, in turn, require adequate lubrication.

Internal combustion engines that are used in outboard motors present particular challenges to a lubrication system. Since the internal combustion engine is operated in a vertical configuration, with the crankshaft rotating about a vertical axis and with the pistons and cylinders disposed in a vertical arrangement, it is common to take advantage of the force of gravity to distribute lubricant throughout the engine. In addition to the use of gravity, it is also well known to those skilled in the art of outboard motor design to utilize differential pressure to distribute oil from one region of an engine to another. As an example, oil which has drained to the bottom portion of an engine region is commonly transmitted to a top bearing zone through the use of differential pressure.

U.S. Pat. No. 5,632,241, which issued to Binzersiel on May 27, 1997, discloses an oil lubricating system for a two-stroke internal combustion engine. The lubricant supply system for the internal combustion engine includes first and second adjacently located and substantially sealed crankcase chambers which alternately experience high and low pressure conditions which are out of phase with respect to the occurrence thereof. First and second oil supply passages communicate with the first and second crankcase chambers. An oil supply circuit includes an oil supply chamber that is adapted to contain oil and have therein a formation including a recess isolated from the oil supply chamber in communicating with the first and second oil supply passages. A metering rod includes an indentation and is supported in the oil supply chamber for movement of the formation between a first position wherein the indentation is located in the oil chamber and a second position wherein the indentation is located in the formation in communication with the recess. When in the first position, the formation affords the filling of the indentation with oil. The system also includes a mechanism for defecting movement of the oil metering rod between the first and second positions.

U.S. Pat. No. 4,599,979, which issued to Breckenfeld et al, on Jul. 15, 1986, describes an upper crankshaft bearing lubrication system for a two cycle engine. The engine has a sump in a lower portion of the crankcase for collecting engine fuel drains and a crankshaft bearing lubrication system includes a first conduit means that is connecting the upper crankshaft bearing in communication with the engine intake manifold. It also includes a second conduit means connecting the upper crankshaft bearing in liquid communication with the sump and has an intermediate portion or reservoir. A third conduit means connects the crankcase in communication with the reservoir. A first check valve is located between the sump and the reservoir permitting fuel drains to flow from the sump upwardly toward the upper crankshaft bearing in response to a suction created in response to the low pressure or vacuum in the intake manifold and prevents backflow from the reservoir to the sump. A second check valve is located between the crankcase and the reservoir and permits flow from the crankcase into the reservoir to pump drains from the reservoir to the upper crankshaft bearing when a high pressure condition exists in the crankcase and for preventing a backflow from the reservoir to the crankcase when a low pressure exists in the crankcase.

U.S. Pat. No. 5,524,581, which issued to Rush et al, on Jun. 11, 1996, discloses an outboard motor with an improved lubrication system. The engine comprises a cylinder block which defines a cylinder, a crankshaft bearing supported in part by the cylinder block, a crankshaft which is rotatably supported by the crankshaft bearing, a piston slidably housed in the cylinder, a connecting rod having one end connected to the piston and having an opposite end connected to the crankshaft, a cylinder head mounted on the cylinder block, a camshaft at least partially supported by the cylinder head for rotation relative thereto, an oil pump with an outlet, a first oil conduit communicating between the oil pump outlet and the crankshaft bearing, and an oil filter communicating with the first oil conduit for filtering oil only in the first oil conduit. In addition, it comprises a second oil conduit that communicates between the oil pump outlet and the camshaft. Oil in the second oil conduit is unfiltered between the pump outlet and the camshaft.

U.S. Pat. 4,820,212, which issued to McElroy et al, on Apr. 11, 1989, describes a marine propulsion device bearing lubrication system. The marine propulsion device comprises an engine, a lower unit adapted to be mounted on the transom of a boat for pivotal movement relative thereto about a generally vertical steering axis with the lower unit including a lower gearcase having a lubricant therein. It also includes a propeller that is rotatably supported by the lower gearcase. A generally vertical driveshaft is rotatably supported in the lower unit and includes an upper end which is driven by the engine. A lower end is drivingly connected to the propeller. An axial bore extends upwardly from the lower end and defines a sleeve portion of the driveshaft. An aperture extends radially through the sleeve portion and internal threads within the axial bore assist in pumping lubricant from the lower gearcase upwardly through the axial bore to the aperture so that the lubricant can flow outwardly through the aperture.

U.S. Pat. No. 4,121,551, which issued to Turner on Oct. 24, 1978, discloses a drain recycle system for a two cycle engine. The internal combustion engine includes a cylinder having a fuel intake port, an exhaust port, and an inlet port located intermediate the intake and exhaust ports. It also includes a piston that is reciprocally mounted in the cylinder and a crankcase which has a drains collection area. A conduit means connects a liquid communication with the drains collecting area and with the inlet port. The drains are recycled or recirculated from the drains collecting area to the cylinder for ultimate combustion therein in response to the cyclical variation of pressure in the crankcase and in the cylinder. In a particular embodiment, the conduit means includes a first conduit which is connected in liquid communication with the drains collecting area and with an upper bearing rotatably supporting the engine crankshaft and a second conduit which is connected in liquid communication with the upper bearing and with the inlet port so that the recirculating drains contact and lubricate the upper bearing en route to the cylinder.

It has been determined that in particular engine designs, certain areas of the crankshaft and support bearings may not be properly lubricated in some circumstances. Because of the location of various seals and because of the cyclical pressure changes of the crankcase regions, certain outboard motors are not properly lubricated if the lubrication system relies solely on gravity to cause the lubricant to flow through the engine. In particular, the two center main bearings of a 6 cylinder two-cycle internal combustion engine do not always receive an adequate supply of lubricant if the forces of gravity are relied upon solely to transmit the lubricant to the center main bearings.

In view of the above, it would be significantly beneficial if a means could be provided to facilitate the flow of lubricant to all critical regions of an internal combustion engine, even when the particular design of the engine block and crankshaft do not always allow gravity to cause lubricant to flow into all portions of the engine and crankshaft region that require lubrication.

SUMMARY OF THE INVENTION

A preferred embodiment of the present invention uses the pulsating pressure within certain regions of the crankcase to draw lubricant into preselected area that require lubrication. The present invention uses a check valve in combination with a source of lubricant and the pulsating pressure in the crankcase to cause lubricant to flow to the center main bearings of the internal combustion engine.

The present invention performs a method of lubricating an engine that comprises the steps of providing a source of lubricating fluid, which can be an outlet port of a compressor, and connecting the lubricating fluid source to a lubricant supply region of the engine. The lubricant supply region of the engine is the location within the engine block to which the oil is initially caused to flow so that it will be transmitted to a region of the engine that is to be lubricated. The lubricant supply region can be a port formed through a wall of the engine block and it can be located between a seal region and a region to be lubricated. In the description of the present invention, the seal region is a region within the engine where a seal is provided between a portion of the crankshaft and a portion of the engine block to prevent the flow of fluid axially along the crankshaft through the seal region. The seal region effectively inhibits the flow of fluid through it by maintaining a close fit between the crankshaft and the engine block, such as with a labyrinth seal. The region to be lubricated, which can be a main bearing, is located between the lubricant supply region and a low pressure region of the engine. The low pressure region of the engine, at least periodically, has a pressure magnitude that is lower than that of the lubricant supply region. The low pressure region of the engine can be a portion of the crankcase and it can experience a pulsating pressure wave that, at least periodically, is less than the pressure of the lubricant supply region to which the lubricant is transmitted from the source of lubricating fluid.

The method performed by the present invention also comprises the step of resisting the flow of the lubricating fluid in a direction from the lubricant supply region to the lubricating fluid source. This resisting step can be performed by a check valve that inhibits the flow of fluid from the lubricant supply region to the source of the lubricating fluid. In other words, the check valve prevents a lubricant from flowing through the port in the wall of the engine back to the fluid source, which is typically a compressor oil discharge port.

A lubricating system made in accordance with the present invention provides an engine that comprises a means for providing a source of lubricating fluid, such as the outlet port of a compressor. It also comprises a means for connecting the lubricating fluid source to a lubricant supply region of the engine. This lubricant supply region is located between a seal region, such as a labyrinth seal, and a region to be lubricated, such as a center main bearing. The region to be lubricated is located between the lubricant supply region and a low pressure region of the engine which at least periodically has a pressure magnitude lower than that of the lubricant supply region. The present invention also comprises a means for resisting the flow of the lubricating fluid in a direction from the lubricant supply region to the lubricating fluid source. The resisting means can be a check valve.

An engine with the lubricating system of the present invention comprises a source of lubricating fluid, which can be an oil drain sort of a compressor that is used to compress the air for use with a direct fuel injection system of the engine. It also comprises a first conduit connected between the source of lubricating fluid and a first lubricant supply region of the engine. The first lubricant supply region is located between a first seal region and a first region to be lubricated. The first region to be lubricated is located between the first lubricant supply region and a first low pressure region of the engine which at least periodically has a pressure magnitude lower than that of the first lubricant supply region. A first check valve resists the flow of lubricating fluid in a direction from the first lubricant supply region to the lubricating fluid source. The first check valve is disposed within the first conduit. A second conduit is provided between the source of lubricating fluid and a second lubricant supply region of the engine. The second lubricant supply region is located between a second seal region and a second region to be lubricated with the second region to be lubricated being located between the second lubricant supply region and a second low pressure region of the engine which at least periodically has a pressure magnitude lower than that of the second lubricant supply region. A second check valve is used to resist the flow of lubricating fluid in a direction from the second lubricant supply region to the lubricating fluid source with the second check valve being disposed within the second conduit.

In a particularly preferred embodiment of the present invention described immediately above, the first region to be lubricated is a first center main bearing and the second region to be lubricated is a second center main bearing. The first conduit described above is a series fluid path that comprises a first tube, a path through a top main bearing of the engine, a path through an upper counterweight space of the engine, a second tube, and a first port through the wall of the engine. The first low pressure region is a piston rod well of the engine located above the first center main bearing. The second conduit is a series fluid path which comprises a third tube, a path through a lower counterweight space of the engine, a path through a bottom main bearing of the engine, a fourth tube, and a second port through the wall of the engine with the second low pressure region being a piston rod well of the engine which is located above the second center main bearing and below the first center main bearing.

Although the basic concept of the present invention can be applied to many different types of engines, a particularly preferred embodiment of the present invention can be used on an internal combustion engine that comprises six pistons and six cylinders with a top two of the six cylinders being disposed above the first center main bearing, a bottom two of the six cylinders being disposed below the second center main bearing, and a center two of the six cylinders being disposed between the first and second center main bearings. As described above, the engine can be a direct fuel injected engine and the lubricating fluid source can be an outlet port of a compressor.

BRIEF DESCRIPTION OF THE DRAWINGS

The present invention will be more fully and completely understood from the reading of the description of the preferred embodiment in conjunction with the drawings in which.

DESCRIPTION OF THE PREFERRED EMBODIMENT

Figure 1:
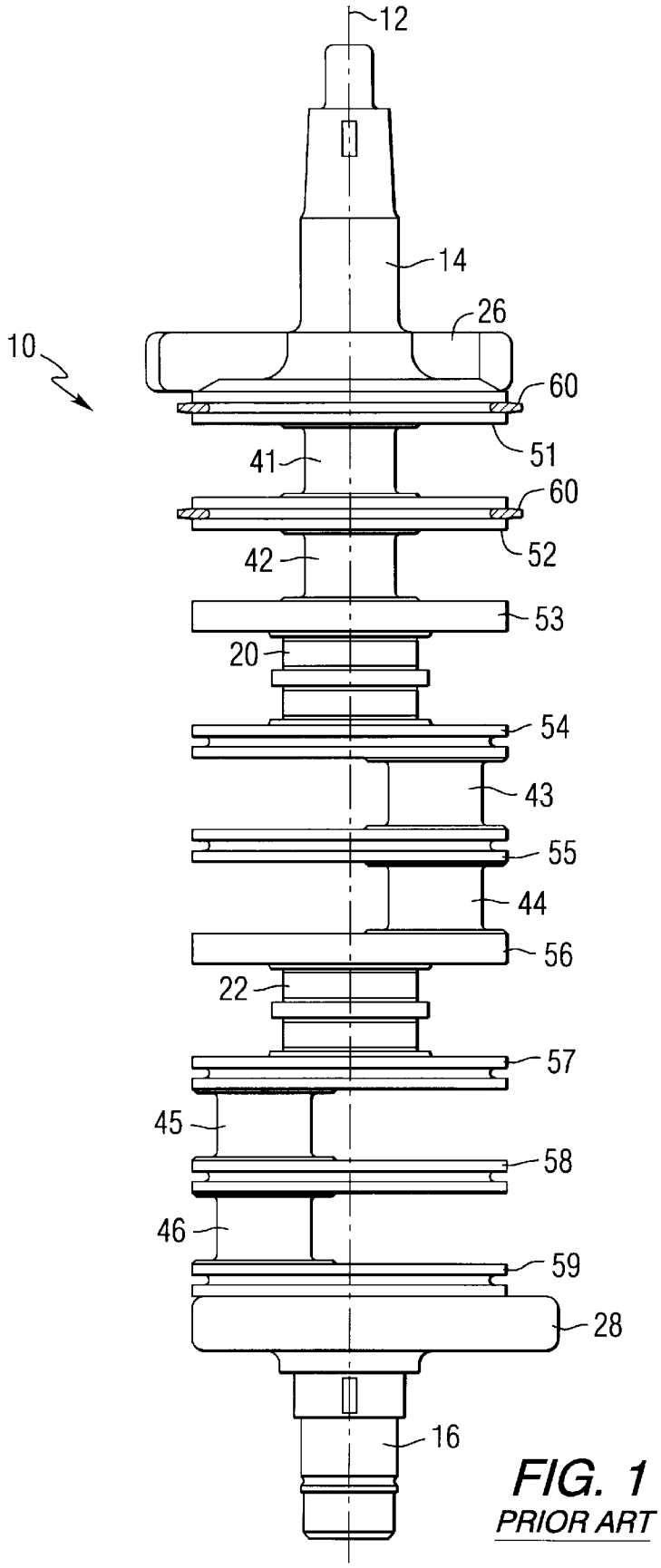
FIG. 1 PRIOR ART
FIG. 1 illustrates a crankshaft used in an internal combustion engine.

Throughout the description of the preferred embodiment, like components will be identified by like reference numerals.

Figure 2:
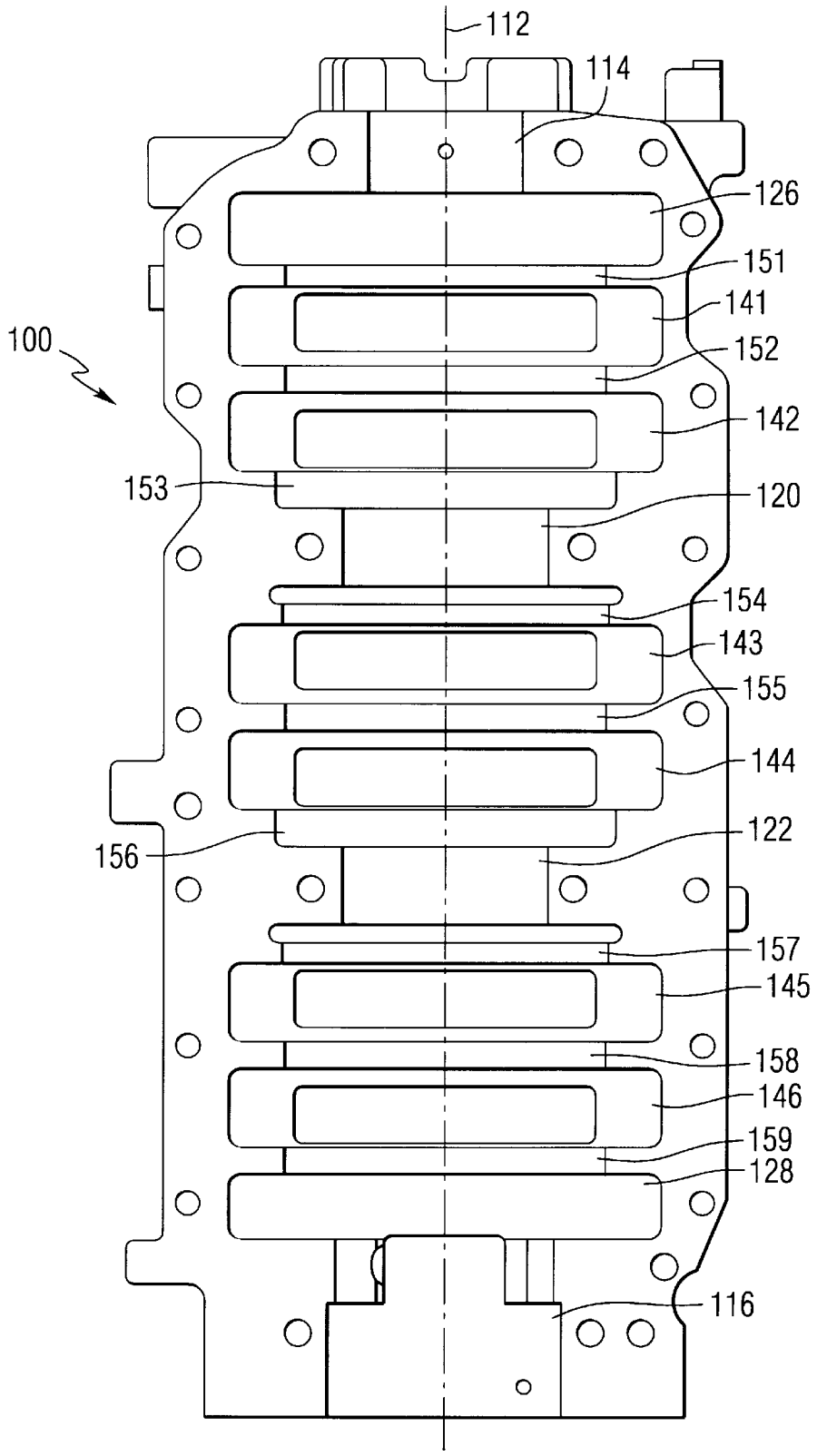
FIG. 2 PRIOR ART
FIG. 2 illustrates an engine block shaped to receive the crankshaft of FIG. 1.

FIGS. 1 and 2, respectively, illustrate the crankshaft 10 and engine block 100 of a six cylinder, two cycle engine. In the description of the preferred embodiment of the present invention, which will begin in conjunction with FIG. 3 below, certain regions of the crankshaft and engine block will be referred to by specific names. These regions will be described below in conjunction with FIGS. 1 and 2 prior to the description of the preferred embodiment.

In FIG. 1, the crankshaft 10 is shaped to rotate about the central axis 12. The crankshaft 10 is supported in an engine block at a plurality of journal positions. A top bearing journal 14 and a bottom bearing journal 16 provide support at the ends of the crankshaft 10. An upper center main bearing journal 20 and a lower center main bearing journal 22 provide support in the central portion of the crankshaft 10. An upper counterweight 26 and a lower counterweight 28 help to balance the crankshaft 10 for smooth rotation at high speeds.

The crankshaft 10 shown in FIG. 1 is intended for use in a 6 cylinder engine. A first rod journal 41 supports the piston rod for the number 1 piston of the six cylinder engine. Similarly, rod journals 42–46 provide driving support for the number 2 through number 6 pistons. A plurality of disc-shaped portions of the crankshaft 10 provide support for the rod journals 41–46. For example, rod journal supports 51 and 52 support rod journal 41 and rod journal supports 52 and 53 support rod journal 42. In FIG. 1, nine rod journal supports, 51–59, are shown. Some of the rod journal supports are provided with a groove for a ring seal 60. These ring structures provide a labyrinth seal between the rod journal supports and a machined surface of the engine block. As can be seen in FIG. 1, grooves rings 60 are provided for rod journal supports 51, 52, 54, 55, 57, 58 and 59. Rod journal supports 53 and 56 are not provided with grooves for sealing rings 60. Only two rings 60 are shown in FIG. 1.

FIG. 2 is a view of an engine block 100, showing the surface exposed by the removal of the crankcase cover of the engine. Axis 112 shows the intended center of rotation of the crankshaft 10 when the crankshaft is placed in the engine block. However, it should be understood that FIG. 2 shows the engine block without the crankshaft 10 or any of the support bearings in place. In the description of the engine block 100, certain regions will be described as the top main bearing 114, the lower main bearing 116, the upper center main bearing 120, and the lower center main bearing 122. However, it should be understood that these locations are illustrated without the actual bearings in place in FIG. 2. It should therefore should also be understood that this terminology is used to describe the races where the bearings would be installed even though they are not actually present in FIG. 2.

The top main bearing 114 and the bottom main bearing 116 provide support for the crankshaft 10 at the ends of the engine block 100. An upper center main bearing 120 and a lower center main bearing 122 support the bearing journals, 20 and 22, respectively. An upper counterweight pocket 126 and a lower counterweight pocket 128 provide space in the engine block for the rotation of the counterweights, 26 and 28, about centerline 112. A first crankcase rod cavity 141 is shaped to allow the piston rod of the number 1 piston to rotate about centerline 112 in continual attachment to the rod journal 41 described above in conjunction with FIG. 1. The spaces in the engine block shown in FIG. 2, which are number ed 141–146, are semicircular pockets with central openings extending through the pockets toward the cylinders of the engine. These central openings are the rectangular shapes illustrated within each of the crankcase rod cavities 141–146.

Reference numeral 151 identifies a surface of the engine block that is generally semicircular and symmetric about line 112. When the crankcase cover is attached to the engine block 100, a semicircular surface in the cover will combine with the semicircular surface identified by reference numeral 151 to provide a circular surface that will cooperate with the ring 60 and rod general support 51 to provide a first labyrinth seal that inhibits the flow of fluid between the top counterweight pocket 126 and the crankcase rod cavity 141 of the number 1 cylinder. In a similar manner, labyrinth seals are also provided at the locations identified by reference numerals 152, 154, 155, 157, 158 and 159. Since no rings 60 are provided between rod general supports 53 and 56 and their associated surfaces, 153 and 156, these regions of the engine block 100 do not intentionally provide a means for inhibiting fluid flow between axial spaces within the engine block. In other words, cavities 153 and 156 are provided to allow space for the rod journal supports 53 and 56 to rotate, but no attempt is made to provide a labyrinth seal in those specific regions of the engine block.

It can be seen in FIG. 2 that both center main bearings, 120 and 122, have a space directly above them which is not provided with a labyrinth seal. These regions, 153 and 156, would normally be expected to allow lubricant to flow downward through the cavities, under the influence of gravity, into the upper and lower center main bearings, 120 and 122. However, even though labyrinth seals are not provided in regions 153 and 156, it has been discovered that oil is reluctant to flow downward through these regions toward the upper and lower center main bearings. As a result, bearing damage can occur to the upper and lower center main bearings.

With continued reference to FIG. 2, it should be understood that each of the crankcase rod cavities, 141–146, exhibits a fluctuating pressure magnitude that results from the reciprocating motion of their respective pistons. The movement of the pistons, in coordination with the movements of the reed blocks for the crankcase regions, creates this fluctuating pressure wave. Because the upper and lower center main bearings could possibly be deprived of adequate lubrication, a means was devised to address this problem and assure adequate lubrication to both center main bearings.

Figure 3:
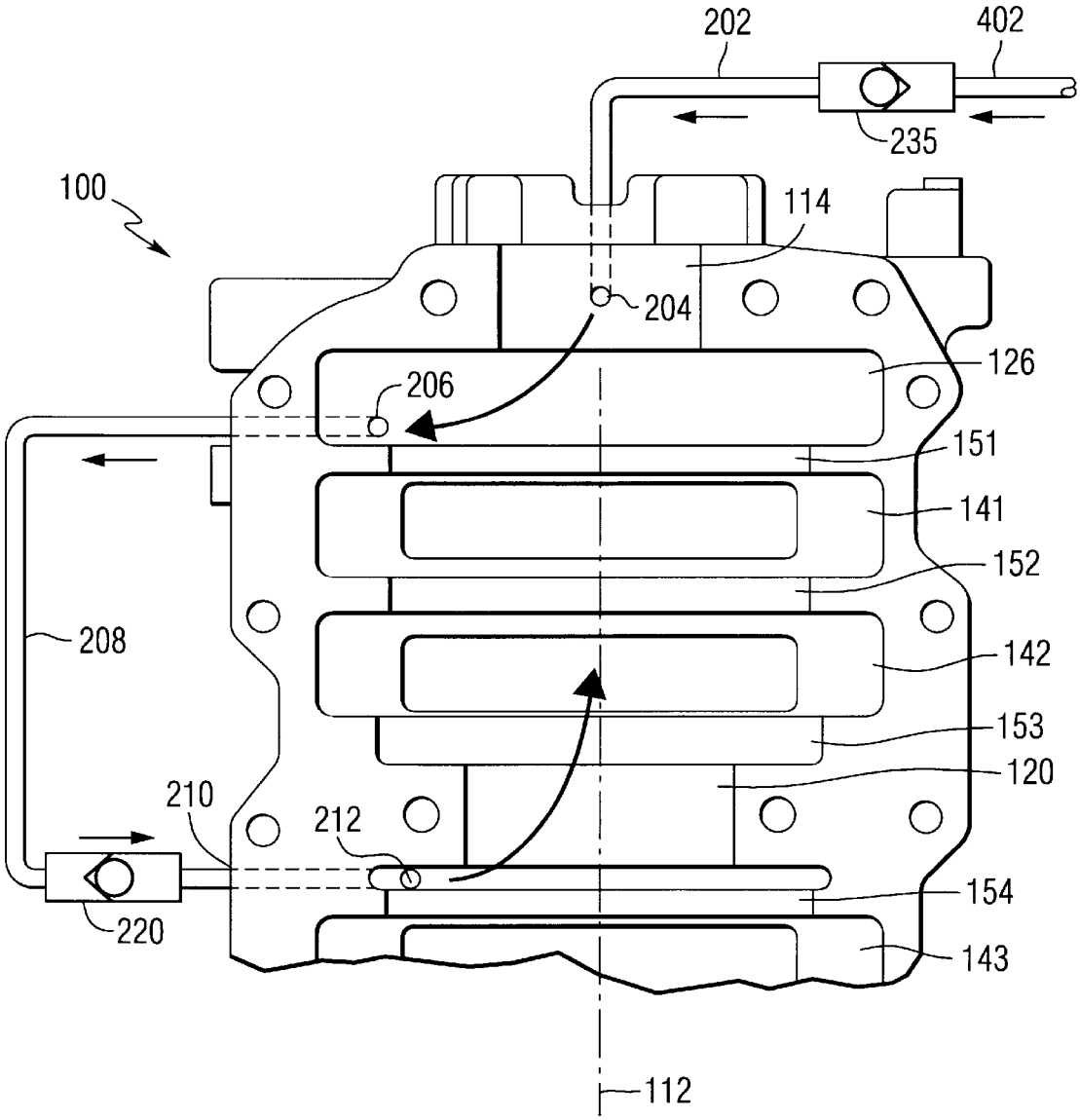
FIG. 3 is an illustration showing an upper portion of the engine block of FIG. 2 in conjunction with a preferred embodiment of the present invention.

FIG. 3 shows an upper portion of the cylinder block 100 which is illustrated in FIG. 2. It should be understood that the present invention will be described in terms of two different embodiments in the same engine block. However, it should also be understood that alternative embodiments of the present invention could utilize only one application in a particular engine block.

A lubricant, such as oil, is transmitted from a lubricating fluid source 233 which will be described in greater detail below. The lubricating fluid source 233 is not illustrated in FIG. 3, but in a preferred embodiment of the present invention it is an oil drain port of a compressor used to compress air for use by a direct fuel injection system used with the internal combustion engine of the outboard motor. A first tube 202 directs lubricating fluid to the main bearing 114. This lubricating fluid is caused to flow through opening 204 to provide a flow of oil to the main bearing 114. After passing through the main bearing, the oil flows downward into the counterweight pocket 126 in which the counterweight 126 is rotating about centerline 112. As it flows through the upper counterweight pocket 126, the oil is agitated. It then flows through opening 206 in the upper counterweight pocket 126 and to a second tube 208 which is connected to a first lubricant supply region 210 which is a port formed through the wall of the engine block 100. This path, which comprises the first tube 202, the path through the top main bearing 114, the path through the upper counterweight space 126, the second tube 208, and the first lubricant supply region 210 comprises the first conduit through which lubricant is provided from the source of lubricating fluid, or compressor, to the first lubricant supply region 210. As described above, the crankcase rod cavity 142 experiences a pulsating pressure in response to the reciprocating movement of the number 2 piston within its cylinder. Because of the location of labyrinth seals 152 and 154, this pulsating pressure wave occurs throughout the region of the crankcase rod cavity 142, the space 153, and the upper center main bearing 120. By providing a check valve 220, this pulsating pressure creates a pumping action that draws lubricant through opening 212 and upward through the upward center main bearing 120. Eventually, the lubricant is drawn through the upper center main bearing 120 and through the crankcase rod cavity 142. From there, the lubricant is burned in the number 2 cylinder combustion chamber. The combination of the pulsating pressure within the crankcase rod cavity 142 of the number 2 piston combines with the action of the check valve 220 to pump oil from the source of lubricating fluid 233 (not illustrated in FIG. 3), through the top main bearing 114, into the first lubricant supply region 210, and through the upper center main bearing 120. This assures an adequate flow of lubricant through the upper center main bearing which would otherwise not be assured simply as a result of the forces of gravity on the lubricant.

Figure 4:
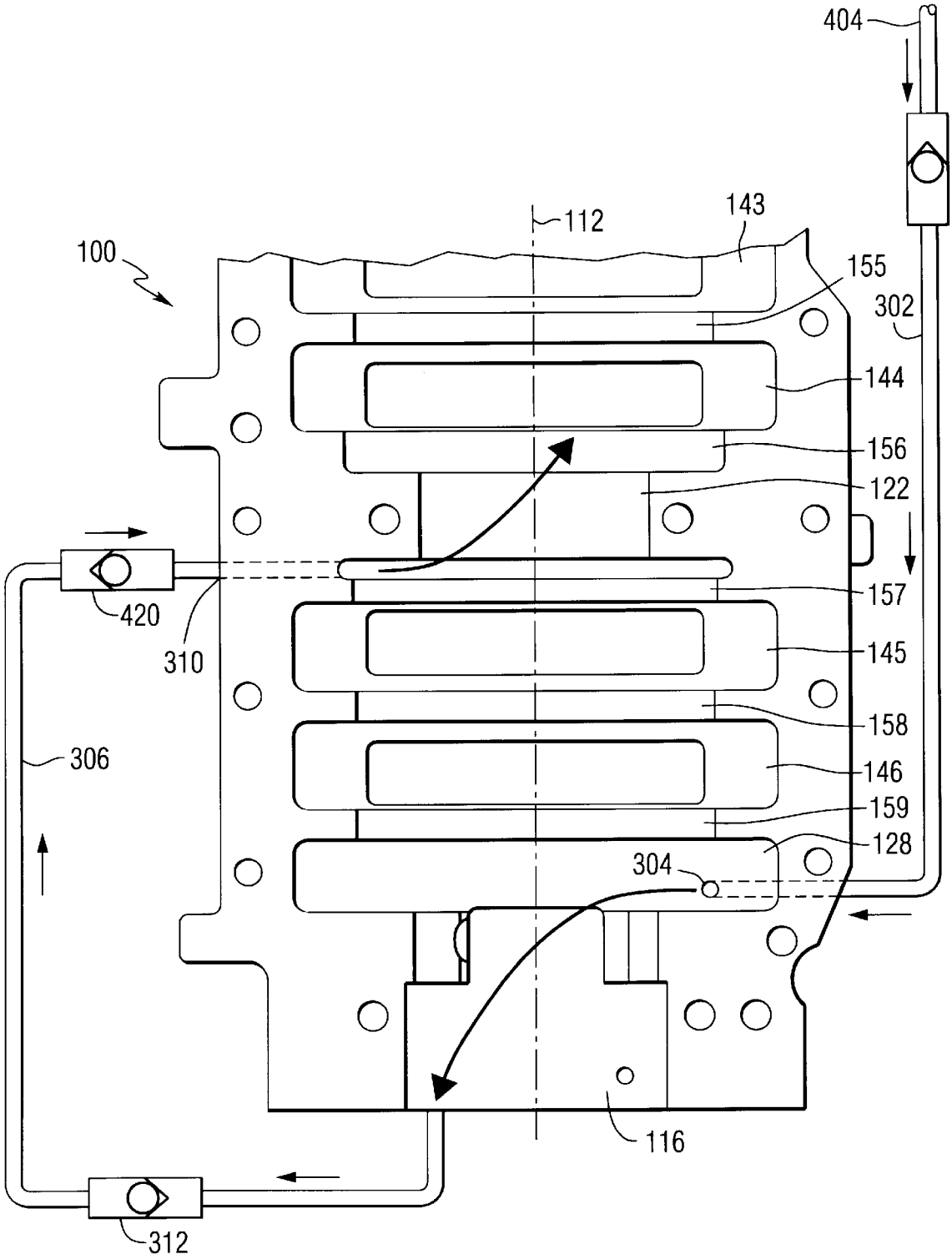
FIG. 4 shows a lower portion of the engine block of FIG. 2 in conjunction with an alternative embodiment of the present invention.

FIG. 4 shows another embodiment of the present invention associated with the engine block 100. From a source of lubricating fluid 233 (not shown in FIG. 4), a flow of lubricant is provided through a third tube 302, a path through the lower counterweight space 128, and through the lower main bearing 116. From the third tube 302, the lubricant passes into the lower counterweight space 128 through hole 304. After passing through the lower main bearing 116, the oil flows through a fourth tube 306 and to a second lubricant supply region 310, which is an opening extending through a wall of the engine block. From the second lubricant supply region 310, the fluid flows upward through the lower center main bearing 122 and into the region 156 prior to being drawn into the crankcase rod cavity 144 for the number 4 piston. The periodically varying pressure in the crankcase rod cavity 144 pulsates in response to the reciprocating motion of the piston within the number 4 cylinder. In combination with the check valve 312, these pressure pulses pump the lubricating fluid from the source of lubricating fluid 233 through a second conduit which is a series fluid path comprising the third tube 302, a path through the lower counterweight space 128, a path through the bottom main bearing 116 of the engine, a fourth tube 306, and a second lubricant supply region 310. After passing through the second conduit, the lubricant is drawn through the lower center main bearing 122 and into the crankcase rod cavity 144 where it is passed into the combustion chamber of the number 4 cylinder and burned. Since the lower center main bearing 122 is located between the labyrinth seal at 157 and the pulsating pressure in the crankcase rod cavity 144, the lubricant passes readily upward through the lower center main bearing 122.

Figure 5:
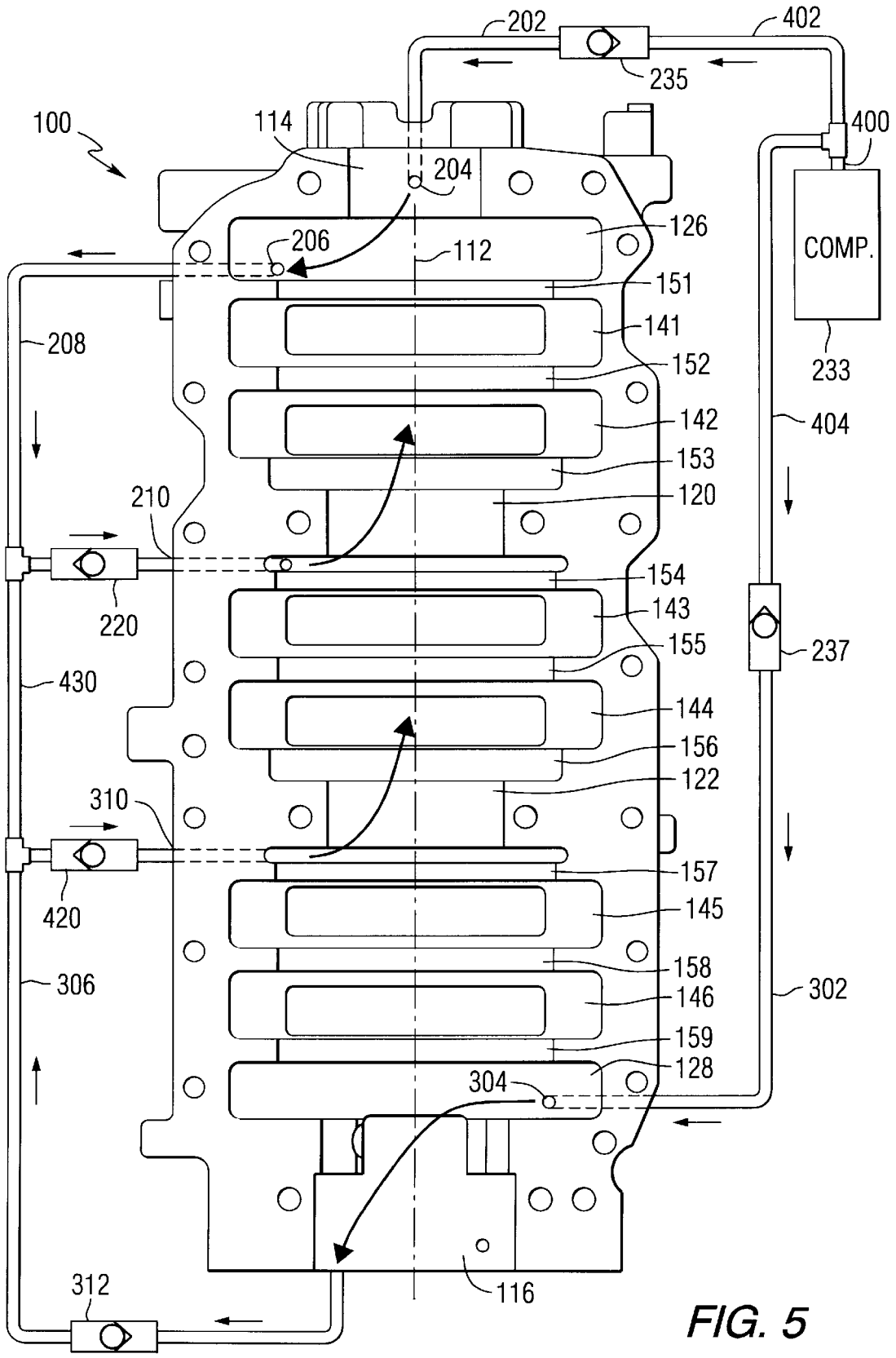
FIG. 5 shows the engine of FIG. 2 in combination with the embodiments illustrated in FIGS. 3 and 4.

FIG. 5 shows the present invention used twice in conjunction with the engine block 100. The embodiment shown in FIG. 3 is employed in the upper half of the engine block 100 while the embodiment of the present invention shown in FIG. 4 is employed in the bottom portion of the engine block 100 in FIG. 5. From the drain port 400 of the compressor 233, lubricant flows in two directions. The first direction is through conduit 402 and the other flow of lubricant is transmitted through conduit 404. The first flow, after passing through conduit 402 from the compressor 233, passes through check valve 235 and into the region of the top main bearing 114. As described above in conjunction with FIG. 3, the lubricant then flows through the top main bearing 114 and into the counterweight space 126. From there, it flows through opening 206 and through the second tube 208 toward the first lubricant supply region 310.

The lubricant flowing from the oil drain 400 of compressor 233 through the other conduit 404 passes through check valve 237 and the third tube 302. After entering the engine block 100, the lubricant flows through opening 304 into the lower counterweight space 128 of the engine and through the bottom main bearing 116 before passing into the fourth tube 306.

In the embodiment shown in FIG. 5, another check valve 420 is also provided to assure that the fluid is inhibited from flowing out of the second lubricant supply region 310 toward the fourth tube 306. This check valve 420 is necessary because the second tube 208 and fourth tube 306 are connected by a fifth tube 430 shown in FIG. 5, but not shown in FIGS. 3 and 4. The fifth tube 430 provides a valuable service when the present invention is used as illustrated in FIG. 5. In addition to the pulsing provided by the crankcase cavity 144 of the number 4 piston to pump the fluid up through the fourth tube 306, it has been determined that certain applications of the present invention can benefit from the additional pulses provided by crankcase rod cavity 142 of the number 2 cylinder. The fifth tube 430 allows the vacuum provided by the number 2 cylinder to be used advantageously to assist in drawing lubricant up through the fourth tube 306 from the bottom main bearing 116. However, it should be understood that the fifth tube 430 is not required in all embodiments of the present invention.

With continued reference to FIG. 5, it should be understood that the advantage achieved through the use of the fifth tube 430 in cooperation with the check valve 220 and the connection to the first supply region 210 is not dependent on the need to lubricate the upper center main bearing 120. Even if the present invention is intended only for the purpose of lubricating the lower center main bearing 122, the use of the fifth tube 430 and check valve 220 can provide a significant advantage in assisting with the lifting of lubricant through the fourth tube 306. In other words, the cyclic vacuum pulses provided by the crankcase rod cavity 142 will provide additional assistance to the vacuum pulses in crankcase rod cavity 144 to lift the lubricant upward from check valve 312 to the lubricant supply region 310. This advantage is achieved through the use of the fifth tube 430 which transmits the pulsations downward toward check valve 312 to draw the lubricant upward. This additional assistance is particularly useful when the lubricant is viscous.

Although the present invention has been described with particular specificity and illustrated in detail to show a preferred embodiment of the present invention, alternative embodiments are also within its scope.

We claim:

1. A method of lubricating an engine, comprising:

providing a source of lubricating fluid, said engine having a plurality of pistons and a plurality of crankcase chambers;

connecting said lubricating fluid source to a lubricant supply region of said engine, said lubricant supply region is disposed between said labyrinth seal and said region to be lubricated, said lubricant supply region being located between a seal region and a region to be lubricated, said seal region containing a labyrinth seal disposed radially between a portion of a crankshaft of said engine and an engine block of said engine, said region to be lubricated being located between said lubricant supply region and a low pressure region of said engine which at least periodically has a pressure magnitude lower than that of said lubricant supply region in direct response to pressure changes within at least one of said crankcase chambers caused by the reciprocating movement of at least one of said plurality of pistons;

resisting the flow of said lubricating fluid in a direction from said lubricant supply region to said lubricating fluid source and connecting said lubricant supply region to a supplemental low pressure region of said engine which at least periodically has a pressure magnitude lower than that of said lubricant supply region in direct response to pressure chances within at least one of said crankcase chambers caused by the reciprocating movement of at least one of said plurality of pistons; and resisting the flow of said lubricating fluid in a direction from said lubricant supply region to said supplemental low pressure region.

2. The method of claim 1, wherein:

said source of lubricating fluid is a drain port of a compressor.

3. The method of claim 1, wherein:

said region to be lubricated is a main bearing of said engine.

4. The method of claim 3, wherein:

said region to be lubricated is a center main bearing of said engine.

5. The method of claim 1, wherein:

said resisting step is performed by a check valve.

6. A lubricating system for an engine, comprising:

means for providing a source of lubricating fluid, said engine having a plurality of pistons and a plurality of crankcase chambers;

means for connecting said lubricating fluid source to a lubricant supply region of said engine, said lubricant supply region being located between a seal region and a region to be lubricated, said region to be lubricated being located between said lubricant supply region and a low pressure region of said engine which at least periodically has a pressure magnitude lower than that of said lubricant supply region in direct response to pressure changes within at least one of said crankcase chambers caused by the reciprocating movement of at least one of said plurality of pistons; and means for resisting the flow of said lubricating fluid in a direction from said lubricant supply region to said lubricating fluid source.

7. The lubricating system of claim 6, wherein:

said seal region contains a labyrinth seal disposed radially between a portion of a crankshaft of said engine and an engine block of said engine.

8. The lubricating system of claim 7, wherein:

said lubricant supply region is disposed between said labyrinth seal and said region to be lubricated.

9. The lubricating system of claim 6, wherein:

said region to be lubricated is a main bearing of said engine.

10. The lubricating system of claim 9, wherein:

said region to be lubricated is a center main bearing of said engine.

11. The lubricating system of claim 6, wherein:

said resisting step is performed by a check valve.

12. An engine having a lubrication system, comprising:

a source of lubricating fluid, said engine having a plurality of pistons and a plurality of crankcase chambers;

a first conduit between said source of lubricating fluid and a first lubricant supply region of said engine, said first lubricant supply region being located between a first seal region and a first region to be lubricated, said first region to be lubricated being located between said first lubricant supply region and a first low pressure region of said engine which at least periodically has a pressure magnitude lower than that of said first lubricant supply region in direct response to pressure changes within at least one of said crankcase chambers caused by the reciprocating movement of at least one of said plurality of pistons;

a first check valve to resist the flow of said lubricating fluid in a direction from said first lubricant supply region to said lubricating fluid source, said first check valve being disposed within said first conduit;

a second conduit between said source of lubricating fluid and a second lubricant supply region of said engine, said second lubricant supply region being located between a second seal region and a second region to be lubricated, said second region to be lubricated being located between said second lubricant supply region and a second low pressure region of said engine which at least periodically has a pressure magnitude lower than that of said second lubricant supply region in direct response to pressure changes within at least one of said crankcase chambers caused by the reciprocating movement of at least one of said plurality of pistons; and a second check valve to resist the flow of said lubricating fluid in a direction from said second lubricant supply region to said lubricating fluid source, said second check valve being disposed within said second conduit.

13. The engine of claim 12, wherein:

said first region to be lubricated is a first center main bearing; and said first conduit is a series fluid path comprising a first tube, a path through a top main bearing of said engine, a path through an upper counterweight space of said engine, a second tube, and said first lubricant supply region, said first low pressure region being a piston rod well of said engine located above said first center main bearing.

14. The engine of claim 13, wherein:

said second region to be lubricated is a second center main bearing; and said second conduit is a series fluid path comprising a third tube, a path through a lower counterweight space of said engine, a path through a bottom main bearing of said engine, a fourth tube, and said second lubricant supply region, said second low pressure region being a piston rod well of said engine located above said second center main bearing and below said first center main bearing.

15. The engine of claim 14, wherein:

said engine comprises six pistons and six cylinders, a top two of said six cylinders are disposed above said first center main bearing, a bottom two of said six cylinders are disposed below said second center main bearing, and a center two of said six cylinders are disposed between said first and second center main bearings.

16. The engine of claim 15, wherein:

said engine is a direct fuel injected engine.

17. The engine of claim 16, wherein:

said lubricating fluid source is an outlet port of a compressor.

* * * * *